United States Patent [19]

Sidén

[11] Patent Number: 4,611,438

[45] Date of Patent: Sep. 16, 1986

[54] ABRASIVE WHEEL FOR PIN BORE CROWNS

[75] Inventor: Jan Sidén, Skellefteå , Sweden

[73] Assignee: Finsliparna AB, Skellefteå , Sweden

[21] Appl. No.: 723,472

[22] Filed: Apr. 15, 1985

[30] Foreign Application Priority Data

Apr. 26, 1984 [SE] Sweden ..... 8402295

[51] Int. Cl.[4] ..... B24D 5/00

[52] U.S. Cl. ..... 51/206 R; 51/181 R

[58] Field of Search ..... 51/206 R, 206 P, 181 R, 51/204, 168, 3, 103 R, 105 R; 125/39; 144/218, 41, 134 R

[56] References Cited

U.S. PATENT DOCUMENTS

| | | | |
|---|---|---|---|
| 140,626 | 7/1873 | Hinners | 144/218 |
| 1,089,247 | 3/1914 | Menyhert et al. | 51/3 |

FOREIGN PATENT DOCUMENTS

| | | | |
|---|---|---|---|
| 0245422 | 5/1912 | Fed. Rep. of Germany | 51/181 R |
| 2320688 | 11/1973 | Fed. Rep. of Germany | 51/206 R |
| 1380146 | 1/1975 | United Kingdom | 144/218 |

*Primary Examiner*—Frederick R. Schmidt
*Assistant Examiner*—Robert A. Rose
*Attorney, Agent, or Firm*—Cushman, Darby & Cushman

[57] ABSTRACT

An abrasive wheel for grinding a drill bit of the kind having hard metal inserts set into a head includes two circular flange portions and a circumferential profile groove between the flange portions corresponding to the end profile intended for drill bit insert. The flange portions (7, 8) and interposed profile groove (10) are included in a first abrasive wheel body (3) having a covering coating of abrasive agent such as diamond, adapted to grind hard metal. At least one other abrasive wheel body (4), is nonrotatable and concentrically connected to one flange portion (7 or 8) of the first abrasive wheel body and, at a greater radial distance from the rotary shaft of the abrasive wheel than the adjacent flange portion of the first abrasive wheel body, has a circumferential end portion (15) having a substantially round cross-sectional form and a coating (16) of an abrasive agent, e.g. boron nitride, adapted to grind the material in the drill bit head.

7 Claims, 1 Drawing Figure

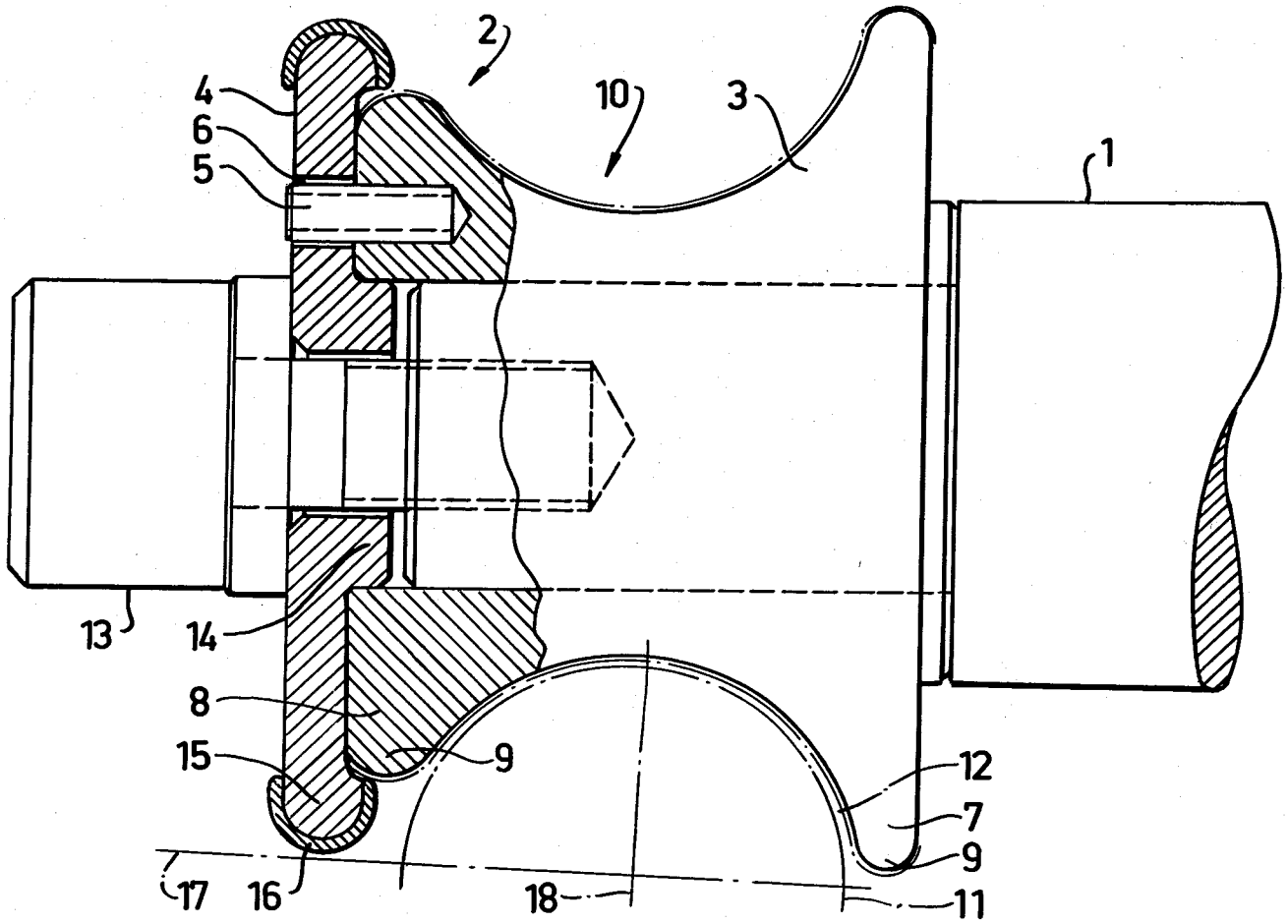
1
2
3
4
5
6
7
8
9
10
11
12
13
14
15
16
17
18

ABRASIVE WHEEL FOR PIN BORE CROWNS

This invention relates to an abrasive wheel for grinding preferably a drill bit of the kind having hard metal inserts set in a head, which abrasive wheel is formed with two circular grinding portions and one profile groove running all around, located between the grinding portions and corresponding to the intended end profile of the insert of the drill bit. The abrasive wheel of the invention is above all intended for use in a grinding machine with a rotatable holder for fixing the insert of the drill bit to be ground in a grinding position coincident with the rotary shaft of the holder, in which position the drill bit has its insert placed on a line with the rotary shaft of the holder to rotate in grinding around its own longitudinal axis, and having a driven spindle supporting the abrasive wheel which spindle is arranged with its rotary shaft for linear motion in a plane through and lying in the rotary shaft of the holder.

Such grinding machines are previously known as well as abrasive wheels of the kind indicated above for grinding such drill bits. These known abrasive wheels are provided with a diamond covering extending across the profile groove of the abrasive wheel as well as its circular grinding portions. This type of abrasive wheel has been found to function extremely well for grinding and shaping of drill bits having small inserts. On the other hand, this type of abrasive wheel has been found to have a limitation for larger drill bits in respect of the working of material around the insert due to the fact that the diamond covering of the abrasive wheel is clogged by the relatively loose material in the drill bit, and consequently a relatively poor working rate is obtained for the material around the insert.

It is therefore the object of the present invention to remove this drawback of the known abrasive wheels of this type and thus to provide an abrasive wheel which is so constituted that it is capable of working the material around the insert of a drill bit at least at the same rate as the inserts independently of the insert size.

This is achieved in that the abrasive wheel of the invention has been given the characteristic features set forth in the claims.

BRIEF DESCRIPTION OF THE DRAWING

FIG. 1 of the drawing shows an elevational side view partly in cross-section of an abrasive wheel for grinding pin bore crowns, according to the present invention.

The invention is described in the following more in detail with reference to the enclosed drawing showing partly in section an abrasive wheel according to the invention as seen from the side and fixedly arranged on its spindle.

In the drawing 1 denotes a spindle of a grinding machine, which can be of a type known per se and is therefore not shown more in detail. On this spindle 1 an abrasive wheel 2 according to the present invention is attached, which consists of at least two abrasive wheel bodies 3, 4 which are nonrotatably and, with respect to the rotary shaft of the spindle, concentrically connected to each other. This nonrotatable connection consists in the embodiment shown on the drawing of a carrier pin 5, which is shown as attached to the abrasive wheel body 3 and extends through a hole 6 in the other abrasive wheel body 4.

The abrasive wheel body designated 3 is formed, on one hand, with two circular flange portions 7, 8, each with an end profile 9 rounded in cross section and of which one 7 or 8 has a larger diameter than the other flange portion 8 and 7, respectively, and, on the other hand, a circumferential profile groove 10 located between the flange portions and corresponding to the end profile intended for the hard metal pin of the insert of the drill bit. Such an insert is shown on the drawings by means of dash and dot lines and is designated 11. The abrasive wheel body 3 intended for grinding the shaping of the hard metal insert has a coating 12 consisting of diamonds and extending also across the rounded ends 9 of the end profiles, as shown on the drawing.

Thus, the abrasive wheel body 3 is intended for grinding and shaping of a drill bit insert, while the other abrasive wheel body 4 included in the present abrasive wheel 2 is intended for working the material in the drill bit head around the insert. The abrasive wheel body designated 4 consists of a relative narrow disc in comparison with the abrasive wheel body 3 which is held in contact with the outside surface of the flange portion designated 8 by means of a locking screw 13, which can be screwed into the spindle, and has a hub portion 14 extending into the abrasive wheel body 3. The abrasive wheel body 4 has a diameter which is larger than the flange portion 8 of the abrasive wheel body 3 and has at its periphery a circumferential thickened end section 15 which is located radially outside the flange portion 8 of the abrasive wheel body and extends somewhat across this as shown on the drawing. This end section 15 of the abrasive wheel body 4 which has a rounded outer contour in cross section is provided with a coating 16 covering the entire end section 15 and of a grinding agent, for example boron nitride, suitable for the material in the insert.

The abrasive wheel body 4, which is connected to the flange portion 8 of the abrasive wheel body 3 formed with the profile groove 10, said flange portion 8 having a smaller diameter, has a diameter which may be less, equal to or larger than the spindle 1 supporting according to the invention the flange portion 7 of the abrasive wheel body having the larger diameter due to the inclination of the abrasive wheel. However, in all the embodiments of the present abrasive wheel the abrasive wheel body 4 with its coating 16 is to come into contact with the material around the pin which is ground before the larger flange portion 7 of the abrasive wheel body in order to obtain the required working of this material and consequently to prevent clogging of the diamond coating 12 on the flange portion 7. This can be effected in many various manners and normally the rotary shaft of the spindle 1 is arranged as inclined relative to the horizontal plane designated 17 in the drawing, and when the spindle 1 arranged for linear motion in a plane through and lying in the centre shaft 18 of the pin adjusted in a grinding position, around which the pin is rotated during the grinding in a way known per se, is displaced downwardly towards the pin 11 adjusted in grinding position the abrasive wheel body 4 with its coating 16 of abrasive agent will work the material around the drill bit insert 11 which is in turn shaped and ground by the abrasive wheel body 3.

It has been found to be possible to achieve a very high working capacity and a rapid grinding of drill bits by means of the present abrasive wheel without risking clogging the diamond covering of the abrasive wheel body designated 3.

The invention is not resticted to what has been described above and shown on the drawing but can of course be modified and changed in several different ways within the scope of the present invention. Thus, it is also possible to arrange an extra abrasive wheel body at the circular flange portion designated 7 of the abrasive wheel body 3 formed with the profile groove 10 instead of the other circular flange portion 8 of said body and/or a replacement of the abrasive wheel body 3 of the flange portion designated 7. Of course the carrier pin 5 can be attached to the abrasive wheel body 4 instead of the abrasive body 3 and extend into a hole made in the latter.

What I claim is:

1. Abrasive wheel for grinding a drill bit of the kind having inserts of hard metal set into a head, the abrasive wheel comprising two circular flange portions and a circumferential profile groove located between the flange portions concentric about a rotary axis and corresponding to an end profile intended for the insert of a drill bit, characterized in that the flange portions and interposed profile groove are included in a first abrasive wheel body having a covering coating of abrasive agent adapted to grind hard metal and that the abrasive wheel includes at least one abrasive wheel body which is nonrotatably and concentrically connected to one flange portion of the first abrasive wheel body and which, at a greater radial distance from the axis of the abrasive wheel than said one flange portion of the first abrasive wheel body, has a circumferential end section with a substantially round cross-sectional form and a coating of an abrasive agent adapted to grind a head of a drill bit.

2. Abrasive wheel as claimed in claim 1, characterized in that the second abrasive wheel body is nonrotatably connected to the first abrasive wheel body by means of a carrier pin fixedly arranged in one of said bodies and extending into a hole in the other.

3. Abrasive wheel as claimed in claim 1, characterized in that said second abrasive wheel body has a peripheral end section which extends across said one flange portion of the first abrasive wheel body.

4. Abrasive wheel as claimed in claim 1, characterized in that the second abrasive wheel body has a diameter not greater than the diameter of the greatest flange portion of the first abrasive wheel body.

5. Abrasive wheel as claimed in claim 1, characterized in that the first abrasive wheel body is mounted on one end of a spindle, in that the first abrasive wheel body has a side facing away from the spindle and in that the second abrasive wheel body is arranged at said side of the first abrasive wheel body.

6. An abrasive wheel for grinding a drill bit of the type having a head and hard metal inserts set into the head comprising: a first abrasive wheel body having an axis about which it is rotatable, said first abrasive wheel body having two axially spacedapart radially extending flange portions each having a periphery which is convexly curved in axial cross section, said flange portions defining the ends of said first abrasive wheel body, and said first abrasive wheel body having, between said two flange portions a circumferential groove having a surface which is concavely curved in axial cross section, said surface merging with the convex surface of each of said flange portions, and a second abrasive wheel body concentric with said first abrasive wheel body and connected to one end of the first abrasive wheel body for rotation therewith, said second abrasive wheel body having a convex circumferential edge which is substantially semicircular in cross section and which is located radially outwardly of said one end of the first abrasive wheel body, said flange portions, said groove and said edge being coated with an abrasive coating.

7. An abrasive wheel as in claim 6 wherein said edge overlies said one end of the first abrasive wheel body.

* * * * *